US007275531B2

(12) United States Patent
Finstad

(10) Patent No.: US 7,275,531 B2
(45) Date of Patent: Oct. 2, 2007

(54) PAINTBALL PROJECTILE DROP COMPENSATOR

(75) Inventor: Mark T. Finstad, Oak Grove, MN (US)

(73) Assignee: KEE Action Sports I LLC, Sewell, NJ (US)

( * ) Notice: Subject to any disclaimer, the term of this patent is extended or adjusted under 35 U.S.C. 154(b) by 0 days.

(21) Appl. No.: 11/384,564

(22) Filed: Mar. 20, 2006

(65) Prior Publication Data

US 2006/0191524 A1 Aug. 31, 2006

Related U.S. Application Data

(63) Continuation of application No. 10/453,122, filed on Jun. 3, 2003, now Pat. No. 7,040,310.

(60) Provisional application No. 60/386,634, filed on Jun. 5, 2002.

(51) Int. Cl.
*F41A 21/00* (2006.01)
*F41B 11/00* (2006.01)

(52) U.S. Cl. ..... 124/81

(58) Field of Classification Search ..... 124/81
See application file for complete search history.

(56) References Cited

U.S. PATENT DOCUMENTS 1,187,218 A 6/1916 Wister
1,348,987 A 8/1920 Fischer
2,119,169 A 5/1938 Lauf
2,182,369 A 12/1939 Barron
2,345,089 A 3/1944 Born
3,101,028 A 8/1963 Berge
3,329,063 A 7/1967 Ehrenburg et al.
3,510,222 A 5/1970 Shaw
3,521,616 A 7/1970 Chang et al.
3,610,222 A 10/1971 Hartman
3,617,000 A 11/1971 Probst et al.
3,669,087 A 6/1972 Hamrick et al.
3,726,266 A 4/1973 Palmer
3,838,676 A 10/1974 Kahelin
3,917,265 A 11/1975 Schrier et al.
3,930,486 A 1/1976 Kahelin
3,989,027 A 11/1976 Kahelin
3,996,916 A 12/1976 Koehn et al.
4,073,280 A 2/1978 Koehn et al.
4,185,824 A 1/1980 Natwick
4,215,867 A 8/1980 Natwick
4,249,465 A 2/1981 Ballmann
4,250,862 A 2/1981 Speer
4,318,329 A 3/1982 Rentzsch et al.
4,323,047 A 4/1982 McIntosh et al.
4,335,701 A 6/1982 Bozich
4,345,578 A 8/1982 Speer
4,570,607 A 2/1986 Stokes (Continued)

*Primary Examiner*—Troy Chambers
(74) *Attorney, Agent, or Firm*—Volpe & Koenig P.C.

(57) ABSTRACT

A barrel attachment for a paintball gun is provided to impart spin onto a paintball exiting the barrel of the paintball gun thereby providing projectile drop compensation. The attachment is made up of a structure having an elongated aperture with a first end that attaches over the barrel of a paintball gun thereby extending the barrel. A second end of the attachment has an open passage that is disposed at an angle to the centerline of the barrel so that a spin is imparted onto a paintball fired from the gun as it passes through the open passage.

14 Claims, 10 Drawing Sheets

U.S. PATENT DOCUMENTS

| | | | |
|---|---|---|---|
| 4,615,325 | A | 10/1986 | Yamamura et al. |
| 5,228,427 | A | 7/1993 | Gardner, Jr. |
| 5,265,583 | A | 11/1993 | Otto |
| 5,337,504 | A | 8/1994 | Krumm |
| 5,337,726 | A | 8/1994 | Wood |
| 5,413,085 | A | 5/1995 | Kraeft |
| 5,450,838 | A | 9/1995 | Nakahigashi et al. |
| 5,613,483 | A | 3/1997 | Lukas et al. |
| 5,634,456 | A | 6/1997 | Perrone |
| 5,640,945 | A | 6/1997 | Slonaker et al. |
| 5,701,878 | A | 12/1997 | Moore et al. |
| 5,735,256 | A | 4/1998 | Monk |
| 5,823,173 | A | 10/1998 | Slonaker et al. |
| 5,832,909 | A | 11/1998 | Grant et al. |
| 5,878,736 | A | 3/1999 | Lotuaco, III |
| 5,988,153 | A | 11/1999 | Yoshimura |
| 6,164,271 | A | 12/2000 | Paulson et al. |
| 6,324,779 | B1 | 12/2001 | Tippmann |
| 6,364,737 | B1 | 4/2002 | Sterr et al. |
| 6,520,172 | B2 | 2/2003 | Perrone |
| 6,526,685 | B2 | 3/2003 | Tippmann |
| 6,805,111 | B2 | 10/2004 | Tippmann |
| 2001/0032638 | A1 | 10/2001 | Yoshimura |
| 2005/0091900 | A1 | 5/2005 | Tippmann |

PAINTBALL PROJECTILE DROP COMPENSATOR

RELATED APPLICATIONS

This application is a Continuation of U.S. application Ser. No. 10/453,122, filed Jun. 3, 2003 U.S. Pat. No. 7,040,310 and claims the benefit of priority pursuant to 35 USC 119 of provisional patent application Ser. No. 60/386,634 filed 5 Jun. 2002, the disclosure of which application is hereby incorporated in its entirety by reference herein.

FIELD OF THE INVENTION

The present invention relates generally to the paintball sporting game, and more specifically to an apparatus for improving paintball gun accuracy in hitting a target and improving the range and trajectory of a paintball fired through the apparatus.

BACKGROUND OF THE INVENTION

A paintball projectile delivered from a paintball gun is affected by gravity to a greater degree than an ordinary bullet because of the peculiar dynamic characteristics and relatively low velocity (<300 FPS) of the paintball when propelled from a paintball gun. One technique for improving delivery accuracy from the paintball gun is to deliberately produce a "backspin" to the paintball as it exits the barrel of the paintball gun.

Tippmann Pneumatics manufacturers a special barrel that is intended to induce a backspin to the paintball exiting the barrel of a paintball gun. This special barrel is intended to replace an existing barrel of one model of their paintball guns that they produce. More specifically, the special Tippmann Pneumatics barrel is curved from the chamber to a few inches out from the chamber. As the paintball goes through the curve portion of the barrel, it develops a backspin.

Another technique for deliberately producing "backspin" to the paintball as it exits the barrel of a paintball gun is incorporated into the paintball gun barrel as manufactured by Armson. In order to produce the backspin onto the paintball, Armson employs a straight barrel that has a swirled pattern on the inside surface of the barrel. This paintball barrel design by Armson is alleged to put a "top spin" on the paintball, which is supposed to make it travel farther.

Other examples, among others, of paintball guns and the like are taught in U.S. Pat. No. 5,823,173, U.S. Pat. No. 5,640,945, and U.S. Pat. No. 5,228,427 are herein incorporated by reference.

SUMMARY OF THE INVENTION

An object of the present invention is to provide a barrel attachment for a paintball gun to induce backspin onto a paintball as it travels from the paintball gun to a target.

Another object of the invention is to provide a barrel attachment for a paintball gun to induce backspin onto a paintball as it travels from the paintball gun to a target that may be applied to a wide variety of manufactured paintball guns.

Another object of the present invention is to provide a paintball backspin compensator that may be easily field adjustable to suit the needs and style of the paintball game player, and accommodate varying field conditions.

Another object of the present invention is to provide a paintball backspin compensator that may be easily adapted to accommodate and be tuned to various paintball diameters.

DETAILED DESCRIPTION OF THE INVENTION

Figure 1:
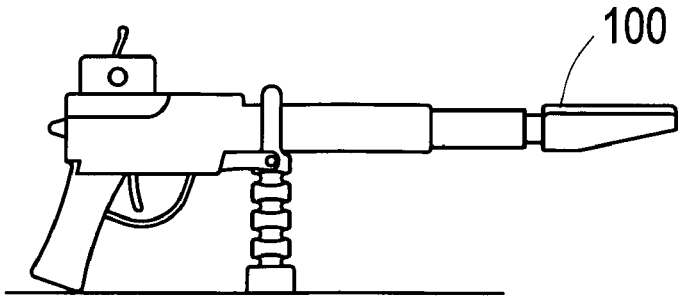
FIG. 1 is a plan view of a paintball gun with the paintball drop compensator in accordance with the present invention.
Figure 2:
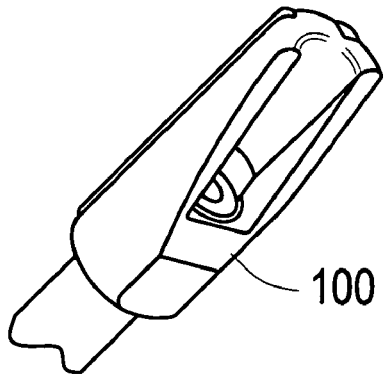
FIG. 2 is a perspective view of the paintball drop compensator in accordance with the present invention.

The paintball drop compensator 100 or paintball barrel spin adapter of the present invention is particularly illustrated in FIGS. 1-5. FIG. 1 illustrates the barrel spin adapter adapted to an end of a common paintball gun. The barrel spin adapter is preferably constructed of a pliable and resilient material for easy adaptation to and removal from a paintball gun.

Figure 3:
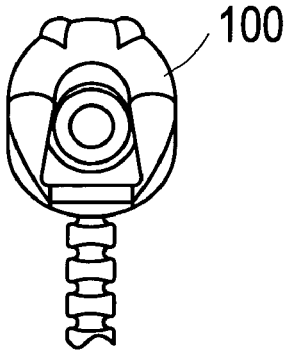
FIG. 3 is a barrel end perspective view of the paintball drop compensator in accordance with the present invention.
Figure 4:
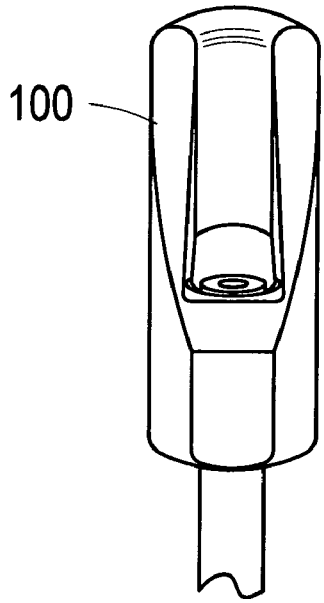
FIG. 4 is top plan view of the paintball drop compensator in accordance with the present invention.
Figure 5:
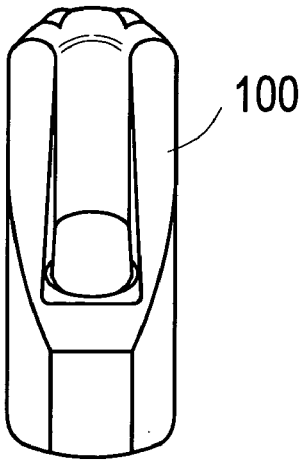
FIG. 5 a bottom perspective view of the paintball drop compensator in accordance with the present invention.
Figure 7:
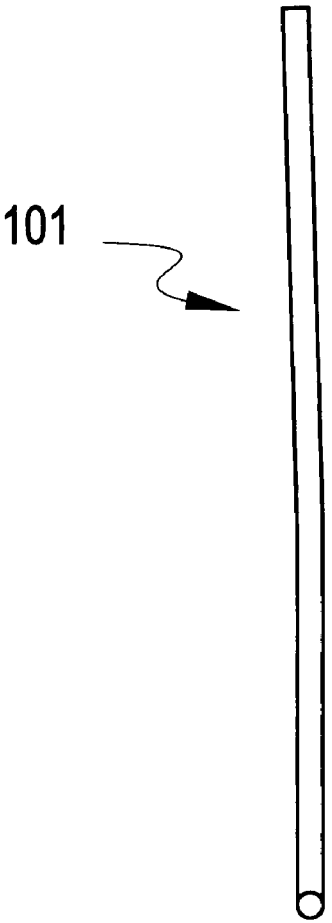
FIG. 7 a wire-line drawing of a pair of adjustment pins in accordance with one aspect of the present invention.
Figure 6:
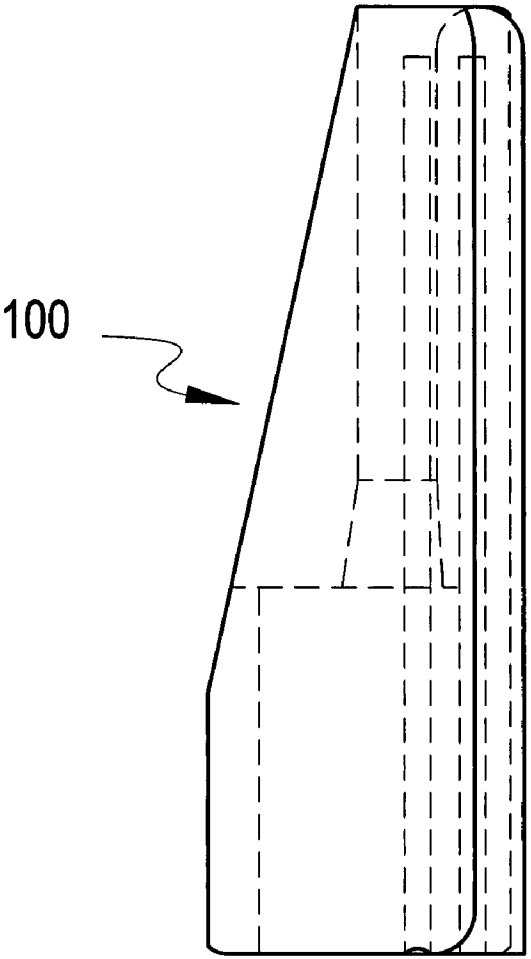
FIG. 6 a wire-line drawing of a side view of the paintball drop compensator in accordance with the present invention.
Figure 8:
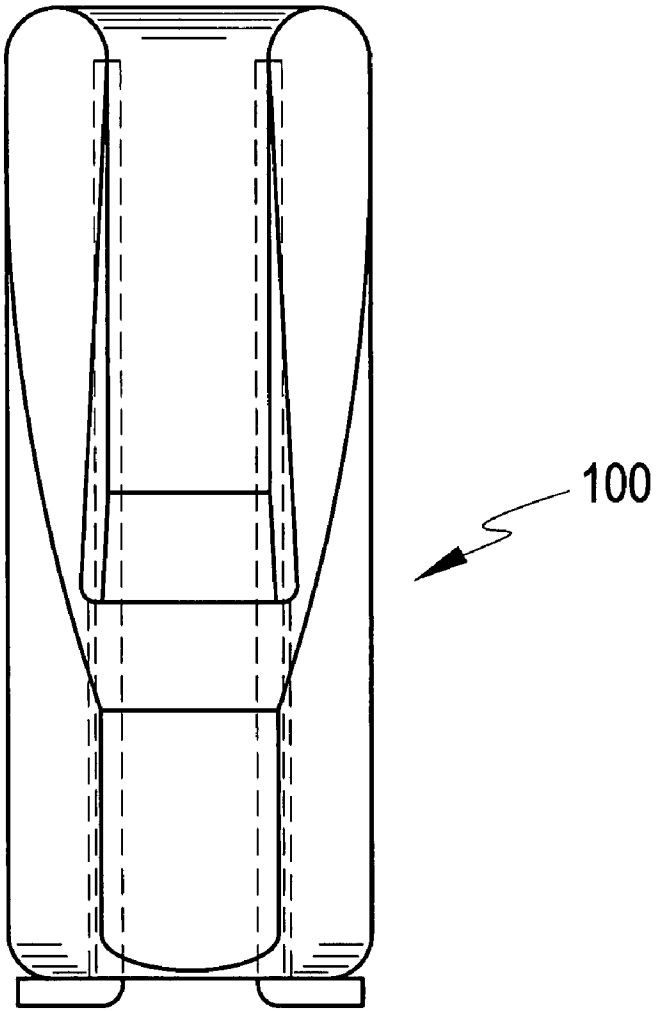
FIG. 8 a wire-frame drawing of a bottom plan view bottom view of the paintball drop compensator in accordance with the present invention.
Figure 10:
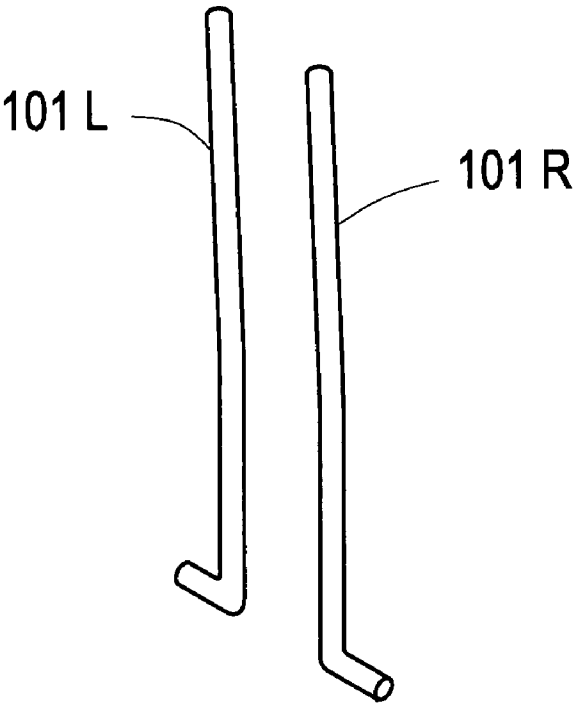
FIG. 10 a wire-frame drawing of a pair of adjustment pins in accordance with one aspect of the present invention.
Figure 9:
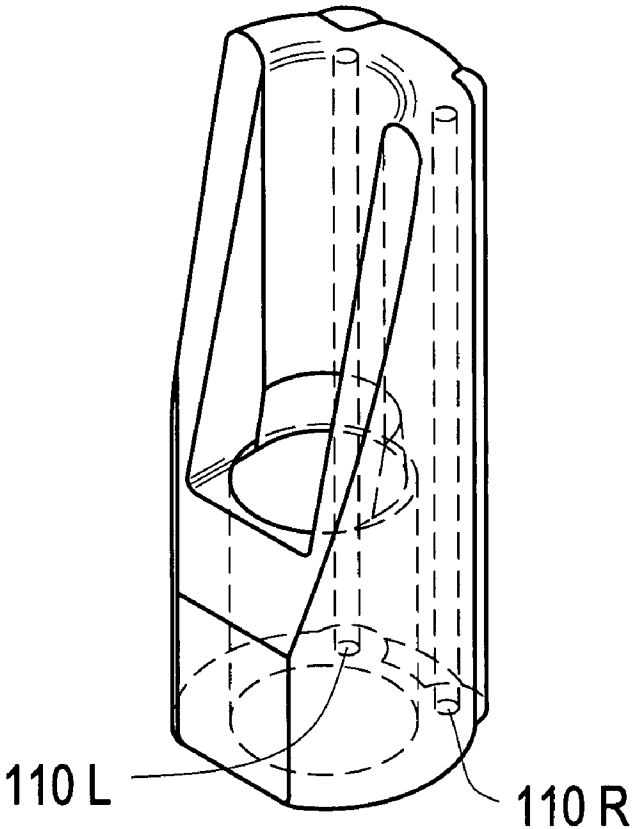
FIG. 9 a wire-frame drawing bottom perspective view of the paintball drop compensator in accordance with the present invention.
Figure 11:
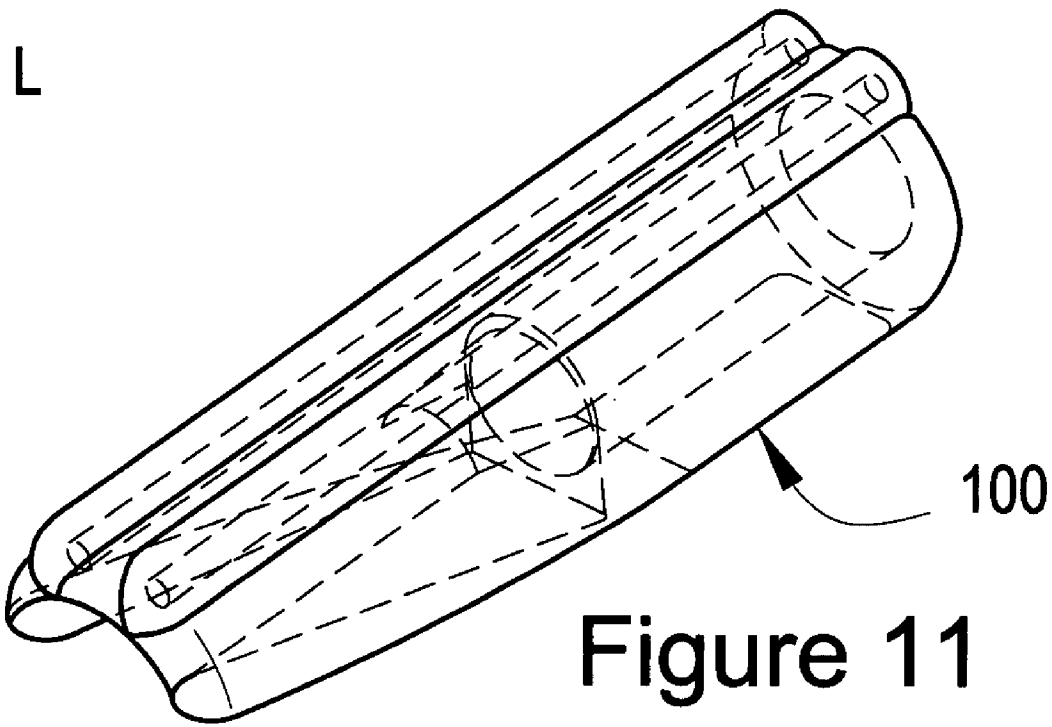
FIG. 11 a wire-frame drawing top perspective view of the paintball drop compensator in accordance with the present invention.
Figure 12:
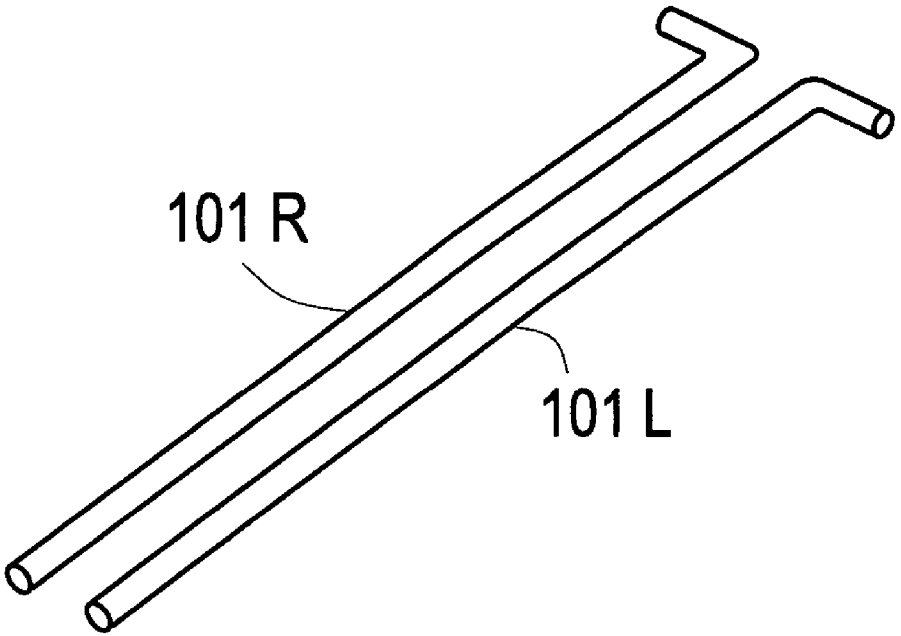
FIG. 12 a wire-line drawing of a pair of adjustment pins in accordance with one aspect of the present invention.
Figure 13:
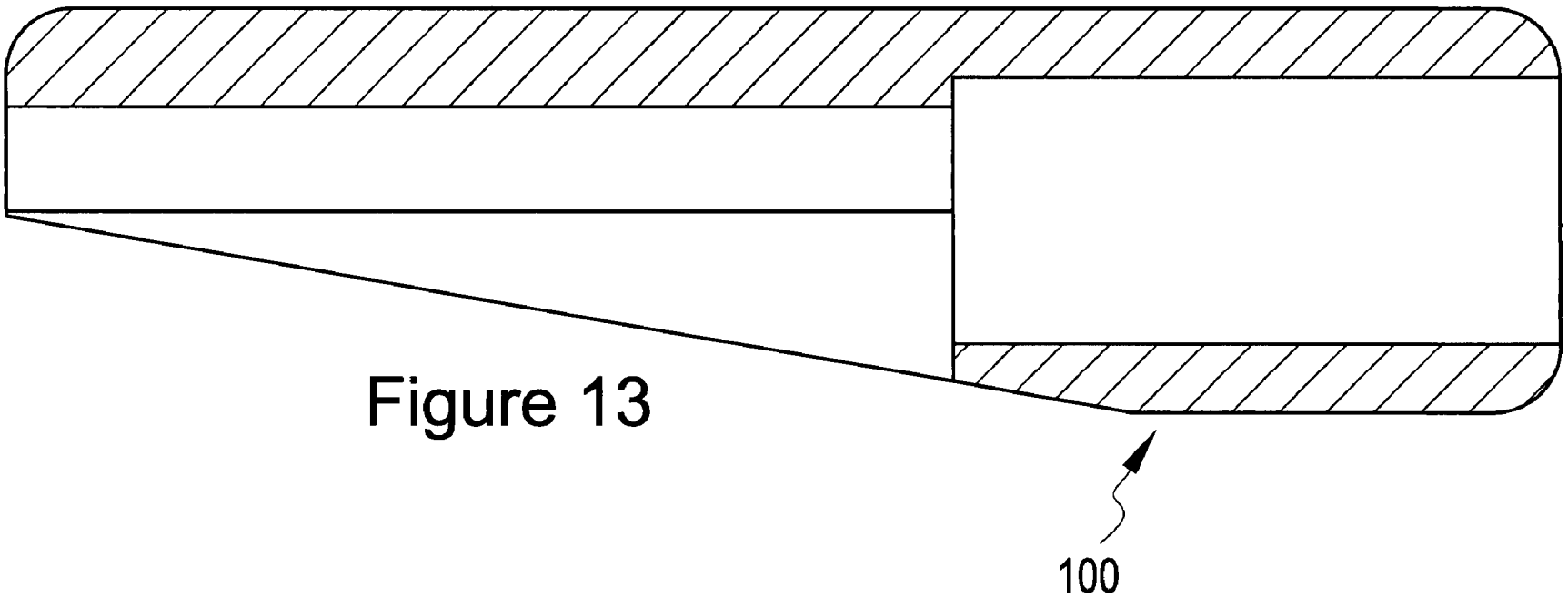
FIG. 13 a cross sectional view through the center of the paintball drop compensator in accordance with the present invention.
Figure 14:
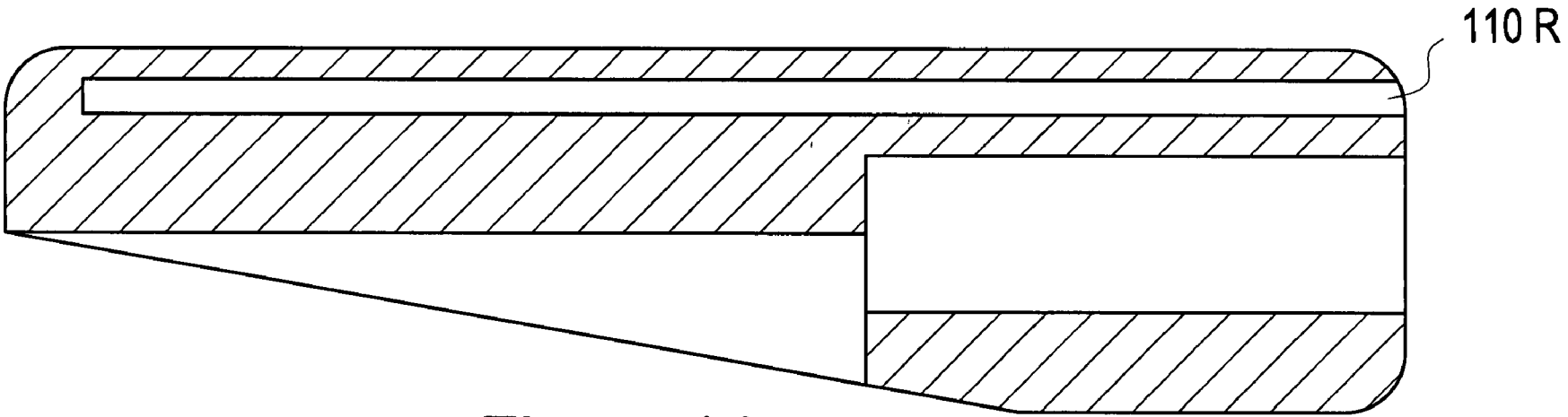
FIG. 14 a cross sectional view through the center of the guide hole for the adjustment pins—pins removed, of the paintball drop compensator in accordance with the present invention.
Figure 15:
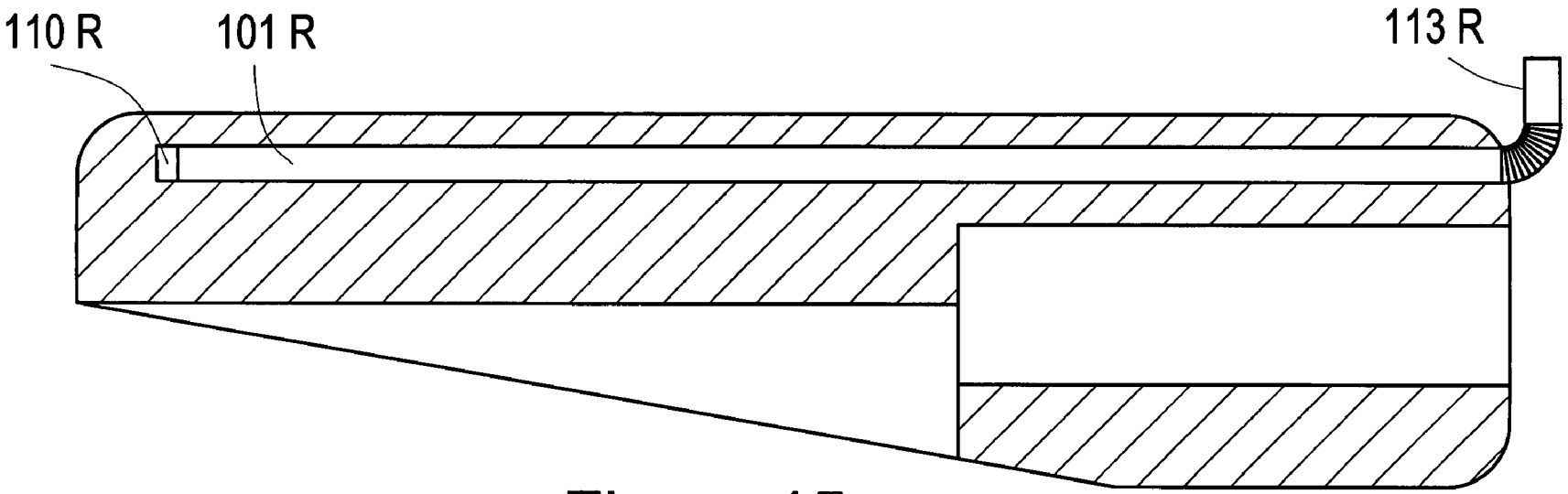
FIG. 15 a cross sectional view through the center of the guide hole for the adjustment pins—pins inserted, of the paintball drop compensator in accordance with the present invention.

The exit portion of the barrel spin adapter is in the shaped of a longitudinally cleaved cylinder creating a "trough" or an open semi-cylindrical cavity that provides an inner surface intended to impart friction to a paintball passing therethrough. The "trough" is intended to be of the approximate diameter of the inside of the barrel (as shown in FIG. 3) and is generally aligned with the barrel, but with a slight angle relative to the longitudinal axis of the paintball gun barrel so that a paintball exiting the barrel will contact the inside surface of the trough as a paintball passes therethrough thereby imparting a back spin thereto. This contact causes friction between the paintball and the trough and causes the paintball to effectively "roll" down the trough. After the paintball has exited the adapter, this roll or backspin causes lift on the paintball as it travels through the air. The lift experienced by the ball counteracts the natural drop due to gravity and causes the ball to have a very flat trajectory.

The aforementioned "slight angle" or bend of the trough relative to the gun barrel may be selected or adjusted to increase or decrease the amount of backspin put on the ball and to accommodate different paintball diameters.

In one embodiment of the invention the trough is tapered to further enhance the backspin in accordance with the present invention. In an exemplary embodiment of the adapter in accordance with the present invention, the end of the trough nearest the barrel has a radius of 0.360 inches, and the exiting end has a radius of 0.340 inches.

In one embodiment of the invention, the adapter is constructed from an elastomeric material. Of course, there are many materials that may be selected in order to provide the intended function. Further, the present invention may incorporated several materials in a laminate configuration. Also, the inner chamber or trough may also be patterned, more or less, to enhance other paintball trajectory and dynamic characteristics.

In accordance with another aspect of the present invention, the choice of materials and design is such that the adapter may be installed rotated to the axis of the barrel in accordance with the desires of the player. This characteristic is particularly important, since many paintball players like to hold their paintball gun tilted at an angle when shooting. In contrast, other known paintball guns with spin systems as already described intended to induce a backspin to the paintball forcibly need to be fired or shot with the gun body perpendicular to the ground or the paintball will curve in the direction the gun is tilted.

In accordance with another aspect of the present invention, the choice of materials and design is such that the adapter may be either removed or disabled in less than 5 seconds if the player wants to shoot a paintball with a normal trajectory during a game (such as high wind conditions).

Figure 16B:
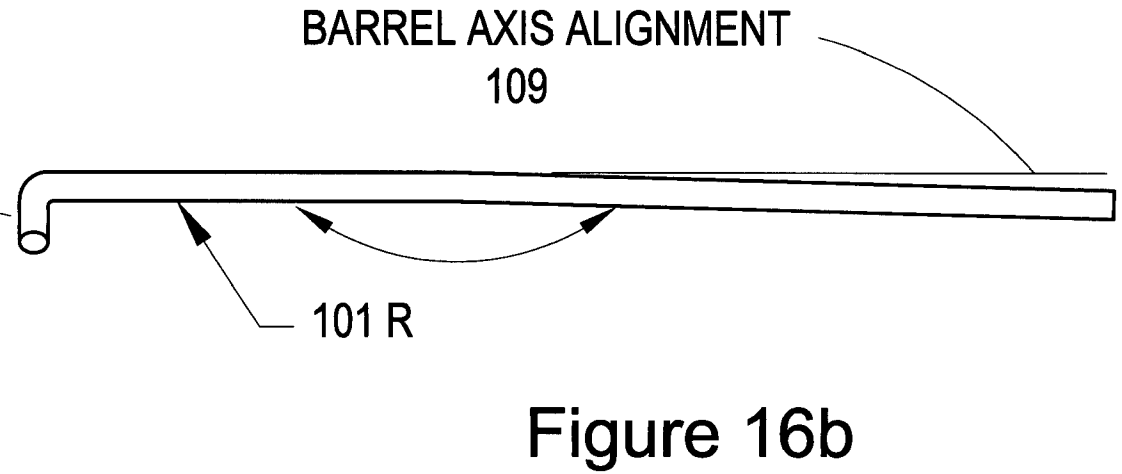
FIGS. 16*a-b* illustrates compensator adjustment pins relative to the barrel end of the compensator with the pins set in one position.
Figure 16A:
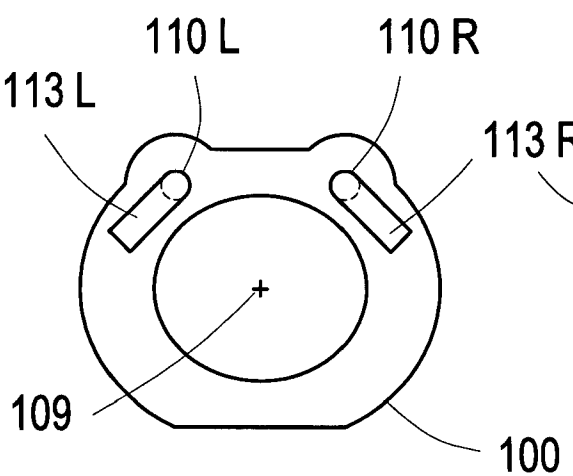
Figure 17B:
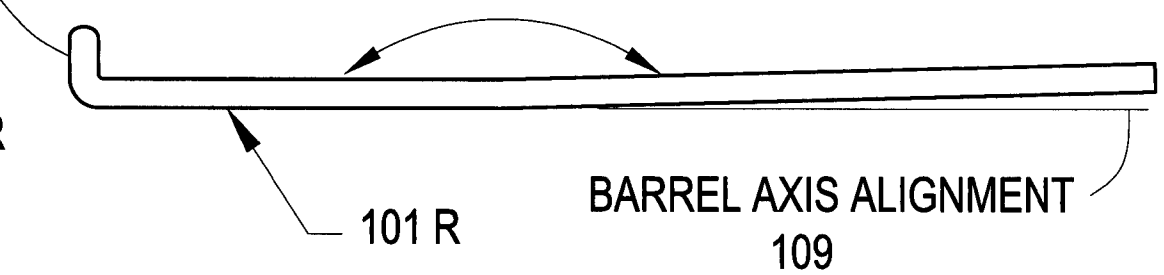
FIGS. 17*a-b* illustrates compensator adjustment pins relative to the barrel end of the compensator with the pins set in another position.
Figure 17A:
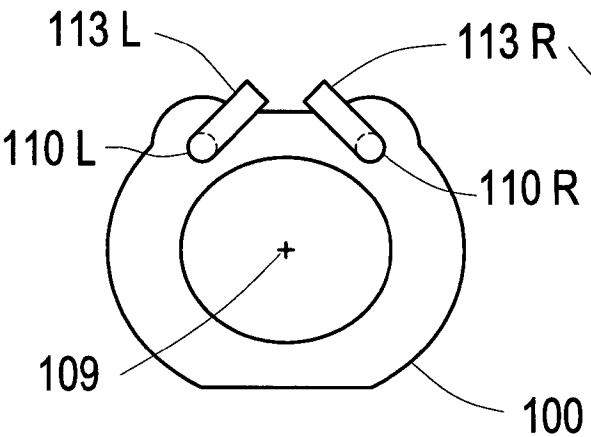

In accordance with another aspect of the present invention, the paintball drop compensator is provided with an adjustment mechanism to further enhance paintball trajectory by way of adjustment pins as illustrated in the drawings and more particularly by those exemplified in FIG. 16*a*, FIG. 17*a*. Longitudinal apertures 110L and 110R are preferably molded into the compensator for accommodating barrel adjustment pins 10L and 10R respectively. Pins 10L and 10R include lever handles 113L 113R respectively.

FIG. 16*a* illustrates the bends in the adjustment pin 101L-R relative to the body of the device (shown in third angle projection). As illustrated in FIG. 16*a*, with pins 101 inserted into the apertures 110, and with the left pin pointing at 135 degrees counter-clockwise from the upward position, and the right pin pointing at an 135 degrees clockwise from the upward position, both pins 101 are bent directly downward relative to the longitudinal axis of the barrel.

Similarly, as illustrated in FIG. 17*a*, with the left pin pointing at 45 degrees clockwise from the upward position, and the right pin pointing at 45 degrees counter-clockwise from the upward position, both the left pin 101L and right pin 101R bend pointing in an upward direction from the central axis of the compensator away from the longitudinal axis of the barrel. Angles shown are approximations and are for reference only.

Accordingly, adjustment of pins 101L-R provide an adjustment to the tapered portion of the drop compensator relative to the barrel axis for providing more or less backspin as desired to the paintball exiting the barrel of the paintball gun.

What is claimed is:

1. A paintball gun having a barrel and barrel spin attachment that induces spin onto a paintball exiting the barrel of the paintball gun, the attachment comprising:

a structure having first and second end portions, said first end portion having a substantially cylindrical cross section and an aperture along a first longitudinal reference axis, said first end portion attached to the barrel of the paintball gun; the structure including an open semi-cylindrical cavity adjacent the second end portion, said cavity is adjustably displaceable towards the longitudinal reference axis of the paintball gun barrel.

2. The barrel spin attachment of claim 1, wherein a paintball exiting the barrel will contact an inside surface of the cavity as a paintball passes therethrough.

3. The barrel spin attachment of claim 1, wherein an inside surface of the open semi-cylindrical cavity imparts friction to a paintball passing therethrough.

4. The barrel spin attachment of claim 1, wherein an inside diameter of the second end portion is substantially equal to a diameter of a paintball.

5. The barrel spin attachment of claim 1, wherein an inside diameter of the second end portion is less than a diameter of a paintball.

6. The barrel spin attachment of claim 1, wherein said first end portion is aligned with a centerline of the barrel, and said open semi-cylindrical cavity is set at a slight angle relative to a longitudinal axis of the paintball gun barrel.

7. The barrel spin attachment of claim 1, wherein the structure comprises an elastomeric material.

8. A paintball gun having a barrel with an attachment for imparting spin onto a paintball exiting the barrel, the attachment comprising:

first and second ends, the first end connected to the barrel of the paintball gun and includes a barrel attachment portion that transitions to a spin portion having a c-shaped cross section, the spin portion is adjustably extendible into a trajectory path to make contact with the paintball exiting the barrel.

9. The attachment of claim 8, wherein a paintball exiting the barrel will contact an inside surface of the spin portion as a paintball passes therethrough.

10. The attachment of claim 9, wherein the inside surface of the spin portion imparts friction to a paintball passing therethrough.

11. The attachment of claim 8, wherein an inside diameter of the spin portion is substantially equal to a diameter of a paintball.

12. The attachment of claim 8, wherein an inside diameter of the spin portion is less than a diameter of a paintball.

13. The attachment of claim 8, wherein said barrel attachment portion is generally aligned with a centerline of the barrel, and a longitudinal axis of said spin portion is set at an angle relative to centerline of the paintball gun barrel.

14. The attachment of claim 8, wherein the structure comprises an elastomeric material.

* * * * *